US009939198B2

(12) United States Patent
Hoffman, Jr. et al.

(10) Patent No.: US 9,939,198 B2
(45) **Date of Patent: *Apr. 10, 2018**

(54) DRYER CONVEYOR BELT TRACKING SYSTEM

(71) Applicant: M&R Printing Equipment, Inc., Roselle, IL (US)

(72) Inventors: Richard C. Hoffman, Jr., Lake Forest, IL (US); Mariusz Switalski, Des Plaines, IL (US); Jerzy Podstawka, Arlington Heights, IL (US); Dariusz Tkacz, Naperville, IL (US)

(73) Assignee: M&R Printing Equipment, Inc., Roselle, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/194,035

(22) Filed: Jun. 27, 2016

(65) Prior Publication Data

US 2017/0030645 A1 Feb. 2, 2017

Related U.S. Application Data

(60) Provisional application No. 62/185,093, filed on Jun. 26, 2015, provisional application No. 62/248,862, filed on Oct. 30, 2015.

(51) Int. Cl.
*F26B 15/12* (2006.01)
*F26B 15/18* (2006.01)

(52) U.S. Cl.
CPC ..... *F26B 15/12* (2013.01); *F26B 15/18* (2013.01)

(58) Field of Classification Search
CPC ..... F26B 15/12; F26B 15/18; B41M 1/12; B41M 15/12; B41F 23/00
USPC ..... 34/207, 167; 101/487
See application file for complete search history.

(56) References Cited

U.S. PATENT DOCUMENTS

| | | | | |
|---|---|---|---|---|
| 1,329,082 A | | 1/1920 | Irwin | |
| 1,407,081 A | * | 2/1922 | Parkes | F26B 13/001 294/5.5 |
| 2,184,905 A | | 12/1939 | Brintnall | |
| 2,432,525 A | | 12/1947 | Kruse | |
| 2,512,128 A | * | 6/1950 | Albright | D21F 5/02 118/68 |

(Continued)

FOREIGN PATENT DOCUMENTS

| | | | | |
|---|---|---|---|---|
| CN | 102015103 | * | 4/2013 | |
| DE | 4236123 C1 | * | 2/1994 | B03B 5/28 |

(Continued)

OTHER PUBLICATIONS

Rhodefer, B.; Google search results: "Re: Need AC zero cross detection circuit"; Newsgroups sci.electronics.de; Aug. 25, 1997; retrieved from Internet on Apr. 23, 2003 (2 pages).

(Continued)

*Primary Examiner* — Stephen M Gravini
(74) *Attorney, Agent, or Firm* — Joseph A. Fuchs; Greensfelder, Hemker & Gale, P.C.

(57) ABSTRACT

The present invention provides a conveyor belt tracking system for a dryer having a web of a mesh material having a protrusion extending along the length proximal one lateral edge and above a flat surface and a first generally cylindrical roller having a three-tiered slot for receiving the protrusion and two flanking shallow tracks for receiving base flanges.

12 Claims, 6 Drawing Sheets

(56) References Cited

U.S. PATENT DOCUMENTS

| | | | | | |
|---|---|---|---|---|---|
| 3,512,989 | A * | 5/1970 | Smith | A23L 7/183 118/18 |
| 3,732,435 | A | 5/1973 | Strandberg, Jr. et al. | |
| 3,928,703 | A | 12/1975 | Cook | |
| 3,943,842 | A | 3/1976 | Bills et al. | |
| 4,086,393 | A | 4/1978 | Hart | |
| 4,112,587 | A | 9/1978 | Sundman | |
| 4,192,751 | A | 3/1980 | Henton et al. | |
| 4,261,288 | A * | 4/1981 | Jurascheck | D06B 3/18 118/212 |
| 4,380,191 | A * | 4/1983 | Gallegos | A21B 5/08 426/439 |
| 4,385,452 | A | 5/1983 | Deschaaf et al. | |
| 4,491,610 | A | 1/1985 | Mansour | |
| 4,495,021 | A | 1/1985 | Goldsworthy | |
| 4,498,941 | A | 2/1985 | Goldsworthy | |
| 4,520,750 | A | 6/1985 | Mansour | |
| 4,567,673 | A | 2/1986 | Bohnensieker | |
| 4,698,767 | A | 10/1987 | Wensel et al. | |
| 5,021,940 | A | 6/1991 | Cox et al. | |
| 5,023,429 | A | 6/1991 | Bailey et al. | |
| 5,117,562 | A | 6/1992 | Dulay et al. | |
| 5,144,108 | A | 9/1992 | Passarotto | |
| 5,218,908 | A | 6/1993 | Whitfield | |
| 5,225,880 | A * | 7/1993 | Shehata | G03G 15/095 15/306.1 |
| 5,239,613 | A | 8/1993 | Motev et al. | |
| 5,361,515 | A | 11/1994 | Peremyschev | |
| 5,426,280 | A | 6/1995 | Smith | |
| 5,447,003 | A | 9/1995 | Warren et al. | |
| 5,489,981 | A | 2/1996 | Killpatrick et al. | |
| 5,538,562 | A * | 7/1996 | Misaki | B08B 1/04 134/15 |
| 5,634,281 | A | 6/1997 | Nugent | |
| 5,651,191 | A | 7/1997 | Walunas et al. | |
| 5,655,312 | A | 8/1997 | Sevcik | |
| 5,797,598 | A | 8/1998 | Marschke et al. | |
| 5,813,134 | A | 9/1998 | Min et al. | |
| 5,828,178 | A | 10/1998 | York et al. | |
| 5,852,881 | A | 12/1998 | Kuroda et al. | |
| 5,908,000 | A | 6/1999 | Spychalla et al. | |
| 5,937,535 | A | 8/1999 | Hoffman, Jr. et al. | |
| 6,026,588 | A | 2/2000 | Clark et al. | |
| 6,161,304 | A | 12/2000 | Iaccino et al. | |
| 6,340,225 | B1 | 1/2002 | Szlucha | |
| 6,388,690 | B1 | 5/2002 | Kurachi | |
| 6,456,826 | B1 | 9/2002 | Toskala et al. | |
| 6,751,888 | B2 | 6/2004 | Lueckenbach | |
| 6,760,981 | B2 | 7/2004 | Leap | |
| 6,779,279 | B2 | 8/2004 | Lee et al. | |
| 2003/0042248 | A1 | 3/2003 | Witt et al. | |
| 2005/0209936 | A1 | 9/2005 | Guy | |
| 2007/0144033 | A1 | 6/2007 | Kocjan et al. | |
| 2007/0193056 | A1 | 8/2007 | Switalski | |
| 2014/0047731 | A1 | 2/2014 | Quirk et al. | |
| 2017/0030645 | A1 * | 2/2017 | Hoffman, Jr. | F26B 15/12 |
| 2017/0067687 | A1 * | 3/2017 | Hoffman, Jr. | F26B 15/12 |

FOREIGN PATENT DOCUMENTS

| | | | | |
|---|---|---|---|---|
| FR | 2614546 | A1 * | 11/1988 | A63C 11/08 |
| GB | 2249824 | A | 5/1995 | |
| GB | 2357827 | A | 7/2001 | |
| IT | 1316230 | | 4/2003 | |
| WO | 9319337 | A2 | 9/1993 | |
| WO | 2011042012 | A1 | 4/2011 | |

OTHER PUBLICATIONS

M&R Printing Equipment, Inc.; Web page for "Product Index: Textile Printing: Mini Sprint" printer (2 pages).

M&R Printing Equipment, Inc.; Web page for "Product Index: Textile Printing: Sprint 2000" printer (2 pages).

M&R Printing Equipment, Inc.; Web page for "Product Index: Textile Printing: Sprint 2000 HO" printer (2 pages).

M&R Sales & Service, Inc.; Product Catalog for Textile Screen Printing Equipment: Mini Sprint, Sprint 2000, and Sprint 2000 HO models; pp. 7-8, published 2001 (3 pages).

M&R Sales & Service, Inc.; Product Catalog for Textile Screen Printing Equipment: Sprint Modular Textile Gas Dryer and Sprint SS Modular Textile Gas Dryer; pp. 23-24; undated (3 pages).

* cited by examiner

DRYER CONVEYOR BELT TRACKING SYSTEM

CROSS-REFERENCE TO RELATED APPLICATIONS

This application claims priority to U.S. Provisional Patent Application No. 62/185,093 filed on Jun. 26, 2015 and U.S. Provisional Patent Application No. 62/248,862 filed on Oct. 30, 2015 both of which are incorporated in their entirety herein by reference and made a part hereof.

FEDERALLY SPONSORED RESEARCH OR DEVELOPMENT

Not applicable.

TECHNICAL FIELD

The present application is directed to a dryer belt control system for a textile dryer.

BACKGROUND OF THE INVENTION

Indicia applied to articles of clothing and other textiles have become very popular. Fanciful indicia, such as slogans, logos, college names, sports team names and logos, and sayings are commonplace.

Indicia are printed using screen printing machines, with one or more colors. Typically, a screen printing machine has at least one station to print each color. Each station generally includes a printing head, which supports a single screen, the ink, and a mechanism for applying the ink to the textile or substrate. The textile to be printed travels between printing stations. The textile is typically carried by a metal pallet, pallet support, flat bed, or platen. Common printing machines are of the turret-type, or are oval or linear in configuration.

Some printing machines incorporate ink curing stations. Other operations employ separate dryers. A dryer has two primary components: a conveyor system and a heating system. Typically, the drying operation includes an operator setting the internal dryer temperature and the conveying speed to achieve the desired drying characteristics. Commonly known mechanisms are employed to determine or read the ambient temperature in the dryer, which allows the operator to adjust the conveyor speed to compensate to achieve the desired drying.

Numerous inks are available. Such inks include water based inks, sublimation inks, and plastisol. The ink is cured or gelled onto the substrate to a critical temperature. The temperature during the curing process must be kept within a suitable window depending on the ink's curing properties, typically between 125 and 450 degrees Fahrenheit. For example, plastisols must reach a temperature of 320 degrees Fahrenheit. In the ranges below 320 degrees and above 350 degrees, the plastisol will not properly set, resulting in cracking, or it may become liquified. Moreover, if a dye in the textile is overheated, it will migrate, or the textile or substrate may scorch or burn, increasing waste and production costs.

To solve this issue, dryers such as disclosed in U.S. Pat. No. 5,937,535 were developed to sense and control the drying process. Dryers are typically electric or gas-powered, use a great deal of energy, and are essentially a heat sink. Commonly assigned U.S. Patent Publication No. 2014/0047731, which is incorporated herein by reference and made a part hereof, discloses a speed control system for a dryer with an improved belt control system that reduces the amount of energy the dryer uses on startup, thereby reducing energy consumed in the drying process, and cutting costs of operation.

Another challenge in using dryers is the manner of making a belt track through the use of crowned rollers and skewing the belt in one direction or another by adjusting bolts until the belt is centered. This manner requires frequent adjustments and readjustments, and can also result in the edges of belts being destroyed because the belt fell out of proper alignment requiring belt replacement. Some belt tracking systems in current use are provided in the dryer tunnel which has the undesired effect of reducing the useable width of the belt ultimately reducing throughput. In one preferred form of the invention, the dryer is a textile dryer, but could be a dryer for other items.

Applicant, M&R Printing Equipment, Inc.'s, Glen Ellyn, Ill., line of dryers, more particularly conveyor dryers, and even more particularly conveyor dryers for textiles. Suitable dryers include infrared electric textile dryers and propane and natural gas conveyor dryers. M&R has designed and manufactured several dryers, the TRANSFORMER™, BLU-FLASH™, FUSION™, RADICURE™, Sprint 3000, Vitran systems. Belt width similarly can vary. Common widths are between 24" to 87" and conveyer lengths ranging from about 82" or longer.

BRIEF DESCRIPTION OF THE DRAWINGS

To understand the present invention, it will now be described by way of example, with reference to the accompanying drawings in which.

DETAILED DESCRIPTION

Figure 1:
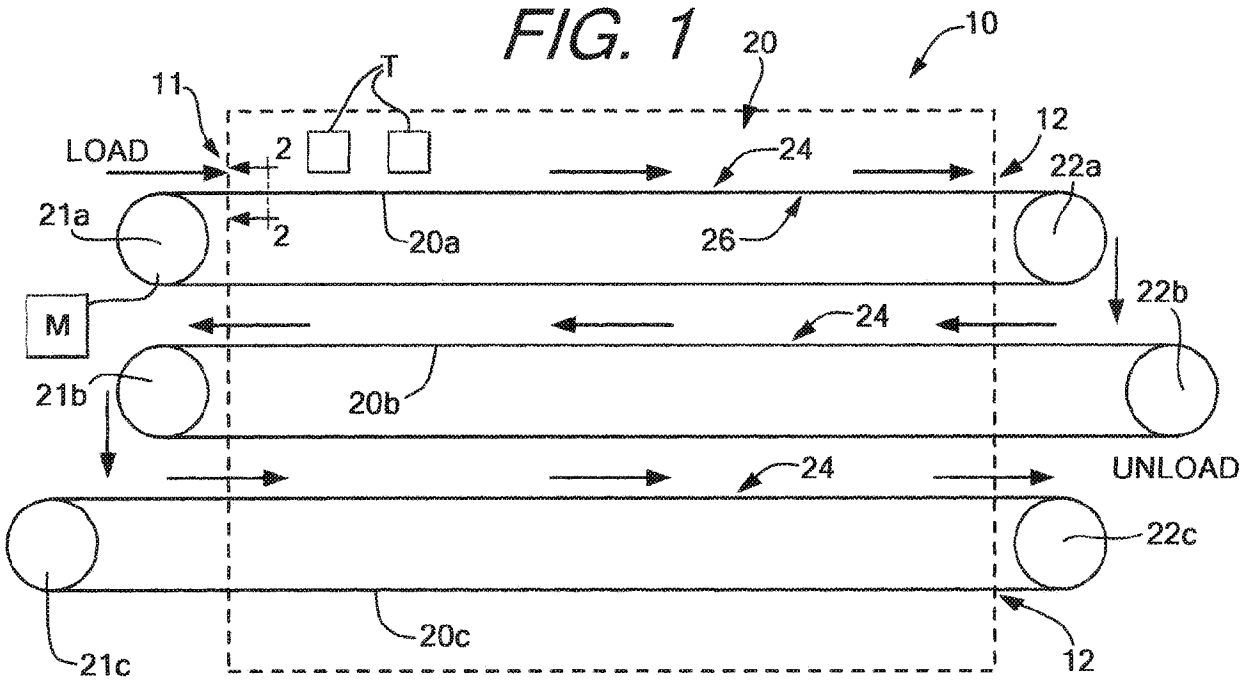
FIG. 1 is a general mechanical schematic of a dryer made in accordance with the teachings of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to the figures, a dryer 10 is shown generally in outline or dashed lines. The housing 10 includes an input opening 11 and an output opening 12 for the conveyor belt 20 ingress and egress from the housing 10. Within the housing 10 is one or more heating elements (not shown) for drying the items placed on the conveyor belt 20. The conveyor belt 20 and associated drive rollers described below can be used with any suitable conveyor dryer system and will be described in reference to a few preferred forms of conveyor dryers but should not be limited to the illustrated embodiments.

The conveyor belt is an endless belt trained about an input roller 21 adjacent the input opening 11 and an output roller 22 adjacent the output opening 12 with at least one of the rollers driven by motor M or other mechanical device or source of motive power to move the belt through the housing 10. The belt has a first surface 24 and a second surface 26. The first surface 24 carries the textiles to be dried, and the second surface 26 contacts the rollers 21,22. The second surface includes a bead 30 in it. Preferably, the bead 30 is continuous and runs the entire length of the belt 20 and is spaced from and extends generally parallel to an edge 32 of the belt. The bead 30 could also be segmented or discontinuous provided there is sufficient lengths of the bead for its intended purpose.

Figure 2:
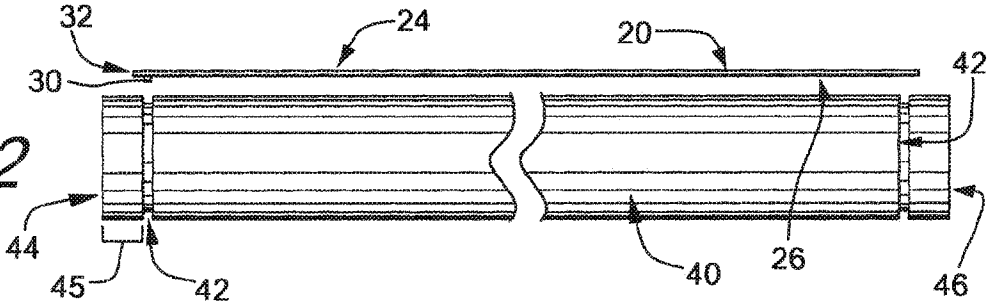
FIG. 2 is a general detail of a roller and the conveyor belt viewed along line 2-2 in FIG. 1.

FIG. 2 shows an exemplary roller 40 and includes at least one guiding groove 42 therein cut or made in the outer surface of the roller 40. This groove 40 is spaced a distance 45 from an end 44 of the roller 40 and has a generally consistent width and depth around the entire circumference of the roller 40. The bead 30 is meant to travel within the guiding groove 42 so as to maintain alignment of the belt as it travels along its path through the housing 10.

In one preferred form of the invention, the dryer has three stacked and vertically spaced conveyor belts 20*a,b,c* and are all driven using the motor M. This type of system is well known in the art. It is preferable that the driving motor M be a heavy-duty, variable-speed DC motor. The rollers 40 are preferably made of a material such as metal including steel, and aluminum for example and the metals can be anodized and/or coated to enhance its surface properties. In one form of the invention, the roller is made of anodized aluminum. The rollers can optionally be crowned for positive belt tracking. An exemplary roller is 78" from end 44 to end 46. The distance 45 is 3.688" and the groove 42 is 0.375" wide. The corners of the grooves are 0.010" at 45 degrees.

Figure 3:
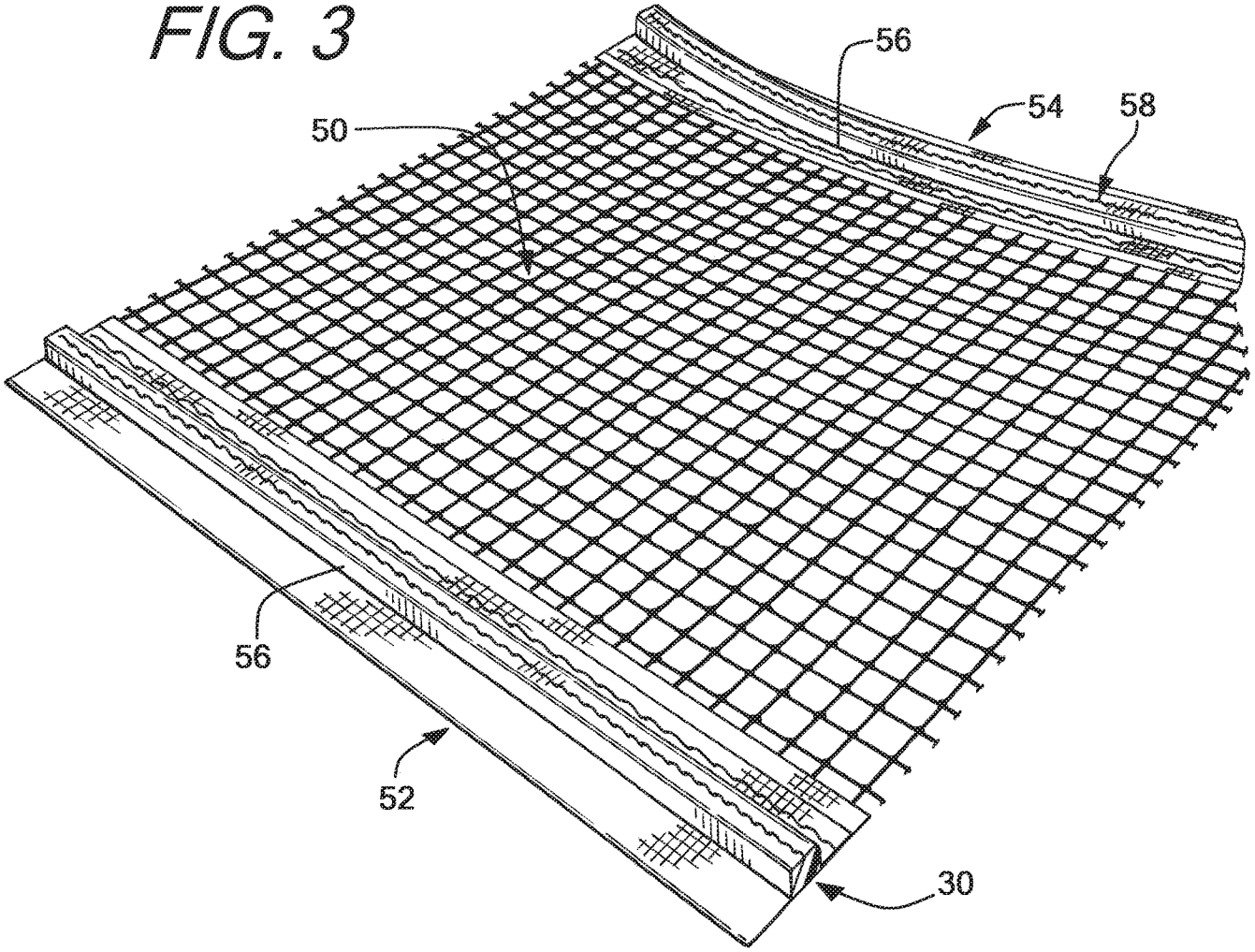
FIG. 3 shows the structure of the conveyor belt.
Figure 5:
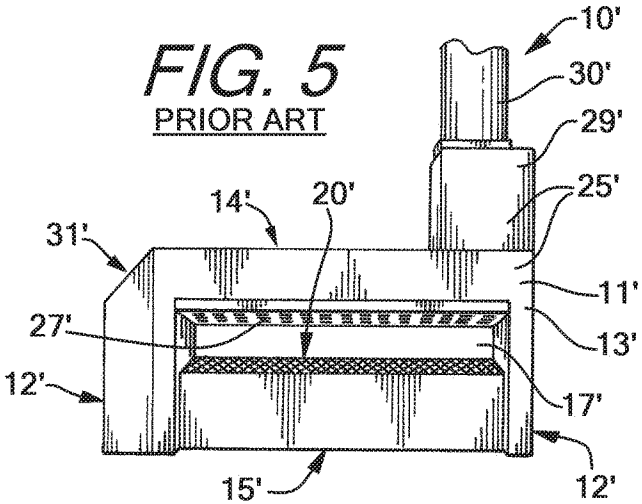
FIG. 5 PRIOR ART
FIG. 5 is a reproduction of FIG. 2 from a commonly assigned prior art patent application U.S. Patent Publication No. 2014/0047731 and is a sectional view of the dryer along line 5-5 of FIG. 4.

As shown in FIG. 3, the conveyor belt 20 is made of heat-resistant, Teflon®-coated fiberglass. It should understood that this is one preferred material for the belt 20 but the conveyor belt could be made of other suitable materials known to those of ordinary skill in the art without departing from the scope of the present invention. The center portion 50 is in the form of mesh and the outer marginal edges 52,54 are a solid fabric 56 sewn 58 along the marginal edges. One marginal edge 52 has the bead 30 sewn therein. Accordingly, the bead 30 is spaced from an outer edge 52 of the belt 20 and the bead 30 is continuous along the length of the belt.

It should be understood that while the bead or guiding strip 30 and the guiding groove 42 are shown and discussed to be on one side, they can be on both sides of the conveyor and rollers, and symmetrical with the single groove/bead arrangement. For example, the roller 40 of FIG. 2 is shown with two grooves. Only one is used. But, both can be used with two beads on the belt. In addition, a third bead and groove can be added. It is parallel to the one bead or parallel to the two beads and runs continuously down the center of the belt and roller. The purpose again is to ensure proper tracking and centering of the conveyor belt 20 or belts as it moves during operation.

The conveyor system is tiered as opposed to being sinusoidal. There is a first tier conveyor system 20*a* with a pair of rollers 21*a*,22*a*, a second tier conveyor system 20*b* with a second pair of rollers 21*b*,22*b*, and a third tier conveyor system 20*c* with a third pair of rollers 21*c*,22*c*. As shown by the arrows, the first and third tier conveyor systems 20*a*,20*c* carry a textile T, such as a t-shirt or a pair of sweat pants, from left to right and the second tier conveyor system 20*b* carries the textiles T from right to left. The second tier conveyor system 20*b* is skewed to the right from the first and third conveyor systems 20*a*,20*c*. Accordingly, a textile T is first loaded by a worker or automatically on the first conveyor 20*a* adjacent the entrance 11 and travels on the first tier 20*a* until it passes over the conveyor's second roller 22*a* where it is passed-off or dropped onto the second tier conveyor system 20*b* adjacent roller 22*b*. The textile T next travels to the roller 21*b* and is passed-off or dropped onto the third tier conveyor system 20*c*. Finally it travels past the roller 22*c* and outside the housing 10 and is unloaded by a worker.

While the above description shows a three tier conveyor system, it can be a sinusoidal conveyor system or have less or more tiers to the system.

The terms "first," "second," "upper," "lower," "front," "back," etc. are used for illustrative purposes only and are not intended to limit the embodiments in any way. The term "plurality" as used herein is intended to indicate any number greater than one, either disjunctively or conjunctively as necessary, up to an infinite number. The terms "attached," "joined" and "connected" as used herein are intended to put or bring two elements together so as to form a unit, and any number of elements, devices, fasteners, etc. may be provided between the joined or connected elements unless otherwise specified by the use of the term "directly" and supported by the drawings.

In another preferred form of the invention, a prior art dryer of U.S. Patent Publication No. 2014/0047731, incorporated herein by reference, and from which FIGS. 1-4 have been renumbered as FIGS. 4-7 herein. The reference numbers have been changed by adding a prime (') to the original number and the section lines 2 and 3 in FIG. 4 have been changed to 5 and 6 respectively to be consistent with the figure numbers used herein. The dryer 10' includes a dryer housing 11' wherein the products passing therethrough are heated. The housing 11' is formed of opposed side walls 12', opposed end walls 13', a top wall 14' and a bottom wall 15'. Such walls are generally constructed of sheet metal and with a double wall to keep the outer wall cool. At one end of the housing there is an entrance 16' and at the other end there is an exit 17'. These entrances and exits are generally openings within the walls. A conveyor system 12' (here a looped belt with a plurality of aperture therein (as a screen)) is driven by a motor (not shown) and passes through the housing 11' between the side 12', top 14' and bottom 15' walls from the entrance 16' to the exit 17'. The ductwork for the system is generally shown at reference number 110'. A cooling/dehumidifying/chilling section 112' is also added. The conveyor 12' shown is totally retained within the dryer housing 11'.

Figure 4:
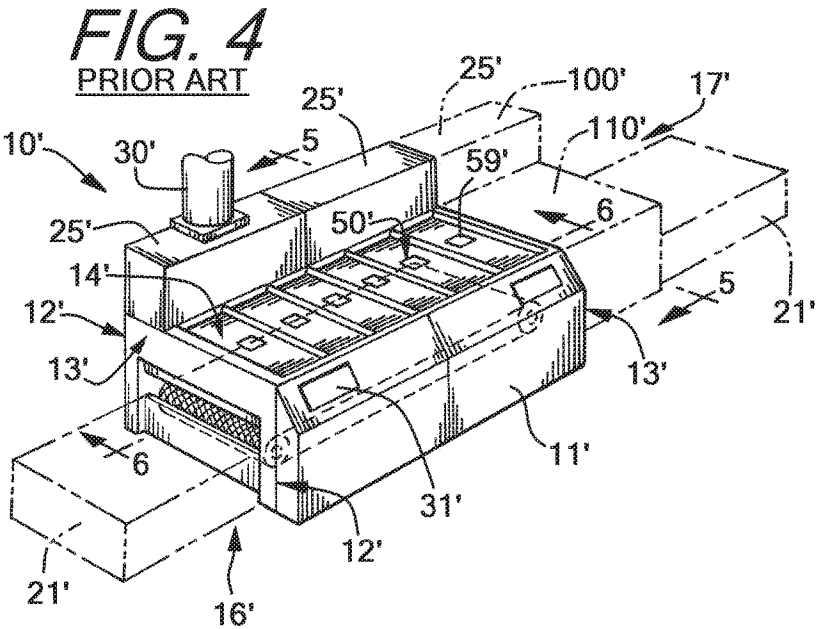
FIG. 4 PRIOR ART
FIG. 4 is a reproduction of FIG. 1 from a commonly assigned prior art patent application U.S. Patent Publication No. 2014/0047731.

Some conveyors extend beyond these openings to points outside the housing (shown in phantom-reference number 21' in FIG. 4).

Heater elements (shown schematically at reference number 122) are within (generally below the conveyor 12') or immediately adjacent the dryer housing 11'. An intake blower and an in-line blower are positioned within or adjacent the housing. Ducts (represented by duct openings 26') bring the air into the dryer housing 11' above the conveyor 12'. There are generally two blowers employed. One blower draws fresh atmospheric air into the system to mix with the gas and burn, and the second blower moves the heated air into the heating area above the conveyor.

Figure 6:
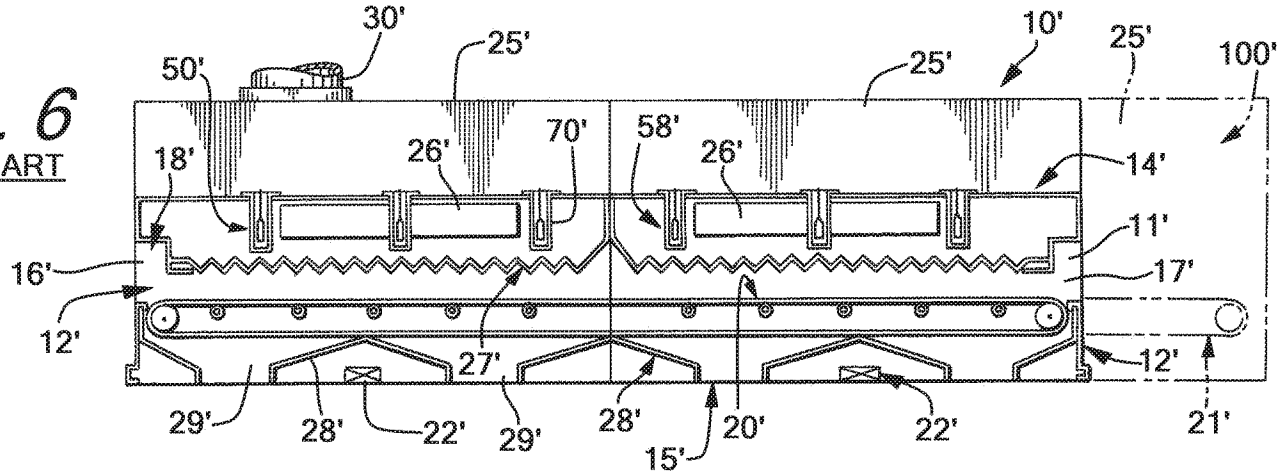
FIG. 6 PRIOR ART
FIG. 6 is a reproduction of FIG. 3 from a commonly assigned prior art patent application U.S. Patent Publication No. 2014/0047731 and is a sectional view of the dryer along line 6-6 of FIG. 4.

In the embodiment shown, there are four "zones" shown. The first zone (preheating zone) is just after the inlet 16' and in the vicinity of the separate infrared preheater 18' (FIG. 6). The second zone is in the vicinity of the first opening 26' for the heated air. The third zone is in the vicinity of the second opening 26' for the heated air. And, the fourth zone is in the chilling section (shown in phantom at 100'). A plurality of overlapping heating air knives 27' (with slits therein) (FIG. 6) are disposed between the conveyor 12' and the duct openings 26' to the intake blowers and the heating elements 22' for ensuring consistent airflow and velocity to and across the entire width of the conveyor 12'. As a result, heated, forced air is blown across the conveyor 12' and any products thereon.

A plurality of inclined deflectors 28' are located below the conveyor 12' for directing the air passing through the housing 11' and conveyor 12' to exhaust ducts (represented by duct openings 29'). An exhaust blower is connected to the exhaust ducts 29' to transport the exhaust air to either a stack 30' for release into the surrounding atmosphere or back into the system 10' to recirculate the heated air and increase the assembly's efficiency.

While not shown, a circulation blower and blower filter screens are also employed. The system is also insulated to ensure safe use thereof.

In most systems, there is a means to detect the temperature inside the housing. Such means include industrial grade thermometers that measure the ambient air within the housing. This information is fed to the control panel 31' and displayed and assists an operator in deciding whether to manually adjust the conveyor's speed, the heat applied, and/or the air movement (cubic feet per minute—"CFM").

Figure 7:
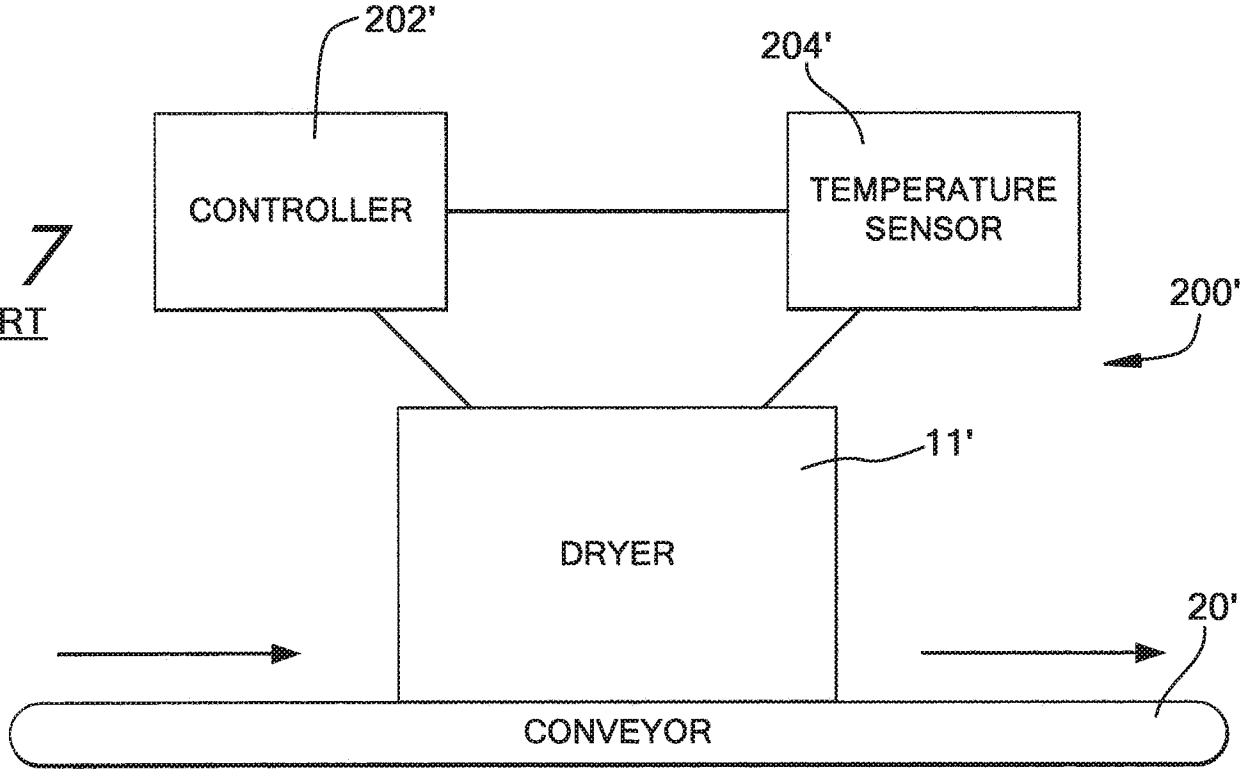
FIG. 7 PRIOR ART
FIG. 7 is a reproduction of FIG. 4 from a commonly assigned prior art patent application U.S. Patent Publication No. 2014/0047731 and is a schematic representation of a drying system.

FIG. 7 is a schematic showing an embodiment of a belt control system 200' of the present invention. The system 200' includes the dryer housing 11' and conveyor 12'. Screen printed articles are placed on the conveyor 12' and through the dryer housing 11' for drying and/or curing of the ink. The speed of the conveyor 12' is controlled by a controller 202'. The controller 202' controls the speed of the conveyor 12' when the dryer 10' is first turned on to limit the conveyor 12' speed to a desired speed until the dryer housing 11' reaches its prescribed working temperature. The temperature is sensed by one or more temperature sensors 204' connected to the controller 202'. It is desired to run the conveyor 12' while the dryer housing 11' is heating up to also heat up the conveyor 12'. It has been found, as described below, that limiting the conveyor 12' speed on startup until the dryer housing 11' has obtained its working temperature, approximately 375 degrees Fahrenheit, results in energy and cost efficiencies and savings. After the dryer housing 101 has reached its desired working temperature, the speed of the conveyor 12' is increased as controlled by the controller 202'.

Below is a chart of test results of natural gas usage and time to an operating temperature of 375 degrees Fahrenheit for a Sprint 60 dryer manufactured by M&R Printing Equipment, Inc., of Glen Ellyn, Ill., at a belt speed of three feet per minute versus twenty feet per minute.

| Conveyor Speed 3 FPM | | | | Conveyor Speed 20 FPM | | | |
|---|---|---|---|---|---|---|---|
| Meter Readings | | Usage (cubic feet) | Time to 375 F. | Meter Readings | | Usage (cubic feet) | Time to 375 F. |
| 312 | 351 | 39 | 7.1 min | 351 | 401 | 50 | 9.0 min |
| 401 | 439 | 38 | 7.1 min | 439 | 490 | 51 | 9.0 min |
| 490 | 529 | 39 | 7.25 min | 529 | 579 | 50 | 9.0 min |
| 579 | 618 | 39 | 7.0 min | 618 | 669 | 51 | 9.0 min |
| Average | | 38.75 | | Average | | 50.5 | |

As the chart above shows, the average natural gas usage for warming up the dryer from 150 to 375 degrees Fahrenheit at 20 feet per minute was 50.5 cubic feet. The average natural gas usage at 3 feet per minute was 38.75 cubic feet, a difference of 11.75 cubic feet.

Moreover, the dryer heated up to 375 degrees approximately 2 minutes faster at a belt speed of 3 feet per minute versus 20 feet per minute. That equates to a 22% time reduction and a 23% gas consumption reduction.

Figure 8A:
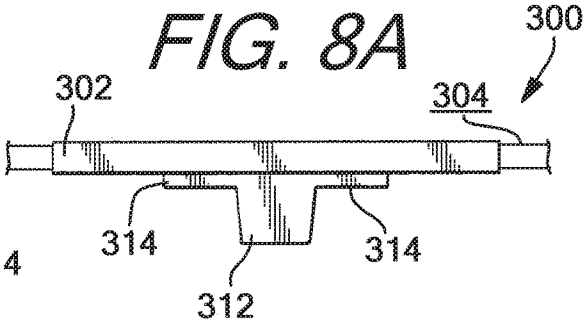
FIG. 8A is an enlarged side elevation view of a belt tracking structure on a conveyor belt.
Figure 8:
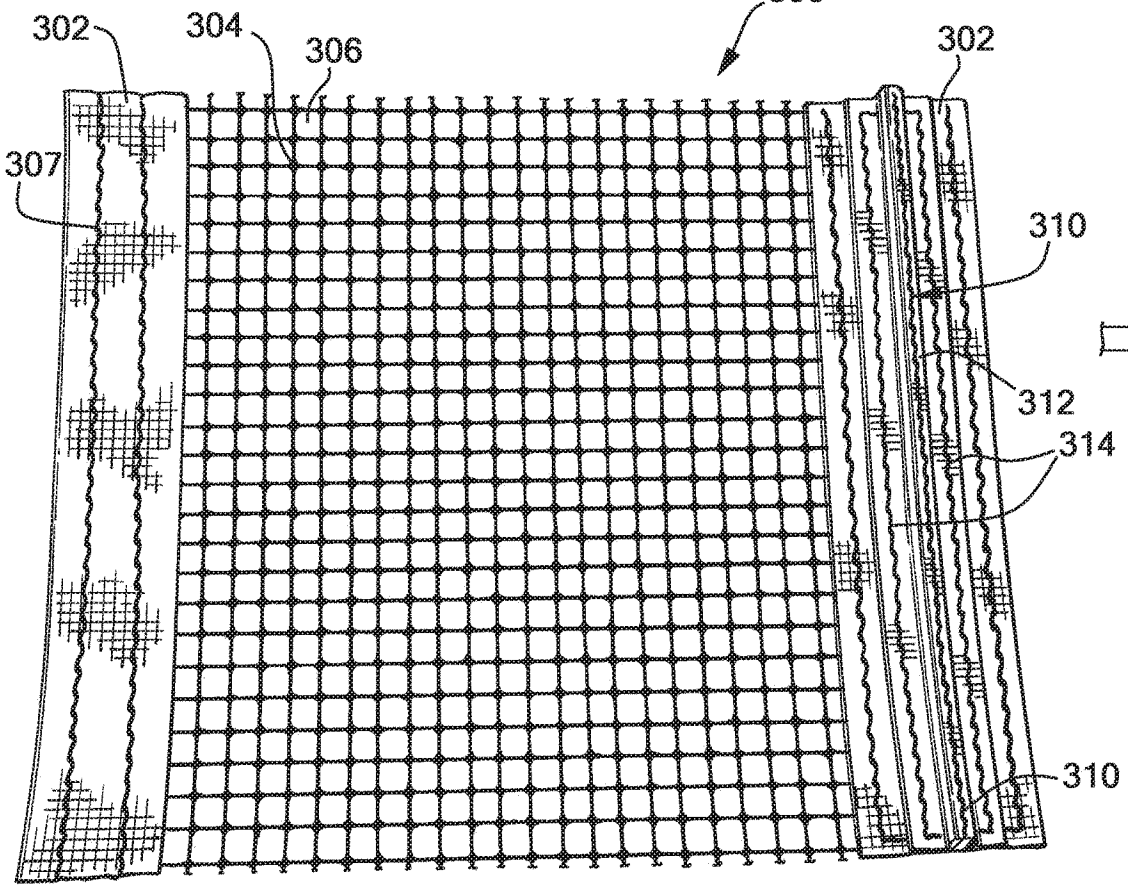
FIG. 8 is a top plan view of a conveyor belt with a belt tracking protrusion of a belt tracking system of the present invention.

FIGS. 8-11 show a conveyor belt tracking system for a textile dryer such as the one described above having a heating chamber. FIGS. 8 and 8A show a dryer belt 300 of a web of porous or mesh material having opposed lateral edges 302, a length, a generally flat surface 304 and a plurality of holes 306 through the web to allow for the passage of heated air. Each lateral edge has a coating material 307 that extends along the length of the belt and fills in the holes 306 to strengthen this lateral portion of the web for contact with rollers described below. Along one lateral edge, a strip of material 310 is secured to the web over the coating material 307. The strip has a pair of base flanges 314 flanking a central peak 312. The base flanges are generally rectangular in vertical cross-section dimension and the central peak 312 is generally trapezoidal in vertical cross-section dimension. The central peak is for guiding the conveyor belt and the flanking flanges 314 increases frictional engagement with the rollers. The base flanges extend above the generally flat surface 304 of the web by a first distance and the peak extends above the surface by a second distance which is greater than the first distance. The strip of material 310 is attached to the belt 300 by means such as sewing or by an adhesive. The web of material forms an endless loop disposed about a pair of spaced rollers. The strip of material 310 is disposed on an inside surface of the endless loop for engaging the rollers to maintain alignment of the belt on its course through the dryer. While the web of material 310 is shown positioned along a single lateral edge, it is contemplated a second strip could be provided on the opposed lateral edge, and a third or additional strips could be used between the lateral edges without departing from the scope of the present invention.

Figure 9:
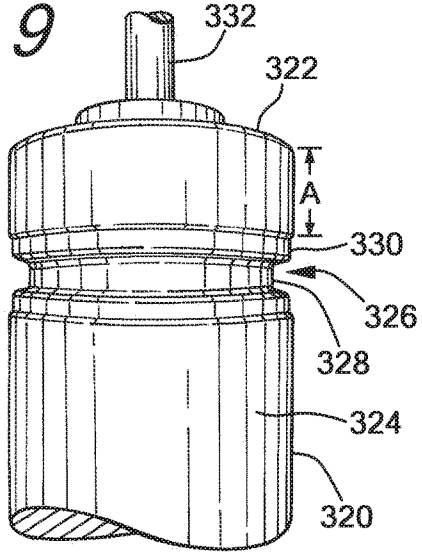
FIG. 9 is a perspective view of a conveyor belt drive roller of a belt tracking system of the present invention.
Figure 11:
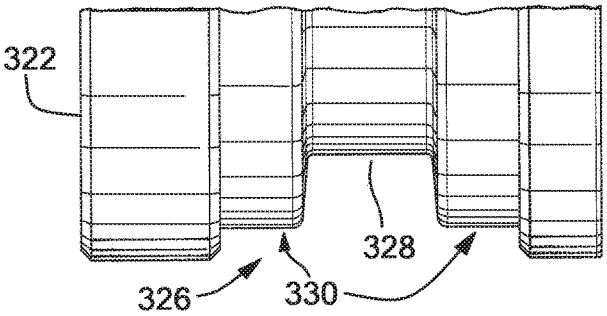
FIG. 11 is an enlarged view of the drive roller of the belt tracking system.

FIGS. 9 and 11 show a first generally cylindrical roller 320 having a circumference, opposed lateral edges 322 and a generally smooth surface 324. A three-tiered slot 326 extends about the circumference and is spaced axially inwardly from a lateral edge 322 by a distance A and extends radially inwardly of the smooth surface. The slot has a central deep track 328 for receiving the peak 312 and two flanking shallow tracks 330 for receiving the base flanges 314. This allows the belt to maintain a constant distance above the surface of the rollers across the entire width of the conveyor even when one lateral edge has the bead and the other does not have the bead. A second cylindrical roller is spaced from the first roller and the belt is trained about the rollers so that the belt moves as the first and second rollers rotate about their axes. A drive shaft 332 is connected to each of the rollers and is driven by a motive force to rotate the rollers about their axes causing the belt to move through the dryer.

Figure 10:
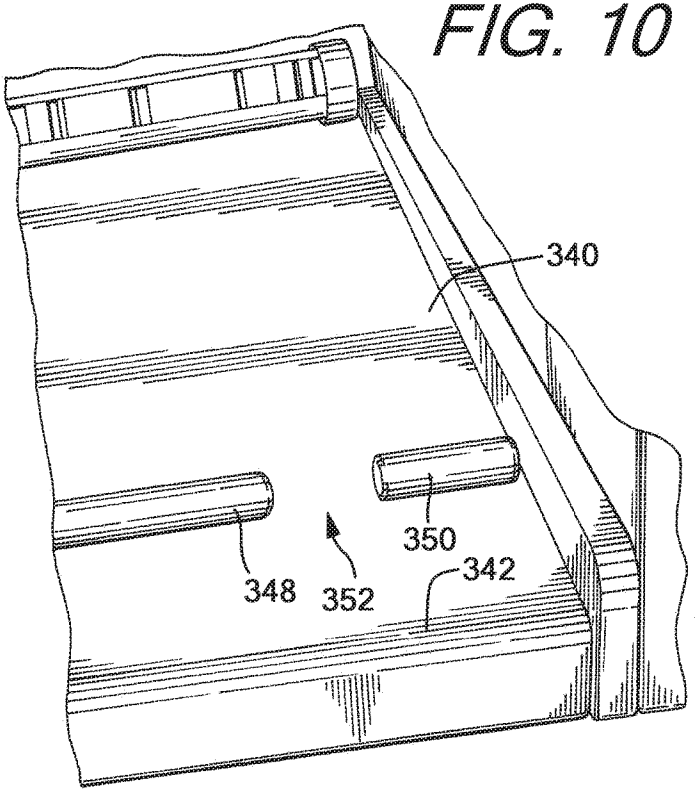
FIG. 10 is a perspective view of an entryway into the dryer of a belt tracking system of the present invention.

FIG. 10 shows a surface 340 that is positioned between the rollers and within the loop of the belt such that the interior surface of the belt faces the surface 340. The surface 340 has an entry point 342 to the dryer, an exit point (not shown) and opposed lateral edges 344. A support member 346 is mounted on the surface 340 and has a first member 348 and a second member 350 spaced from the first member with a gap or notch 352 therebetween. The gap 352 accommodates the passage of the strip of material 310. In a preferred form of the invention, the second member 350 has a length roughly equal to the distance A so that the notch is in alignment with the three-tiered slot 326. In a preferred form of the invention, two support members are provided with each support member being associated with a roller and positioned proximal thereto.

While the specific embodiments have been illustrated and described, numerous modifications come to mind without significantly departing from the spirit of the invention, and the scope of protection is only limited by the scope of the accompanying Claims.

What is claimed is:

1. A dryer comprising:

a housing defining a drying chamber;

a conveyor of an endless web of a mesh material inside the housing and having opposed lateral edges, a length, and a generally flat surface, a protrusion extending along the length proximal one lateral edge and above the flat surface, the protrusion having a central peak and flanking base flanges; and a pair of generally cylindrical rollers within the housing and spaced from one another and the endless web mounted on the rollers for movement with the rollers, each of the rollers having a circumference, opposed lateral edges and a generally smooth surface, a three-tiered slot extends about the circumference spaced axially inwardly from a lateral edge and extends radially inwardly of the smooth surface and having a central deep track for receiving the protrusion and two flanking shallow tracks for receiving the base flanges.

2. The system of claim 1 further comprising a support extending between the opposed lateral edges and having a surface for contacting the web and a notch in the surface to accommodate the protrusion.

3. The dryer of claim 1 wherein at least one of the pair of rollers is driven by a heavy-duty, variable-speed DC motor.

4. The dryer of claim 1 wherein the web is made of heat-resistant, polytetrafluoroethylene coated fiberglass mesh.

5. The dryer of claim 4 wherein the rollers are anodized aluminum rollers.

6. The dryer of claim 1 wherein the protrusion is spaced from an outer edge of the web and the protrusion is continuous along the length of the web.

7. The dryer of claim 6 wherein both rollers have at least one guiding groove therein for cooperating with the protrusion.

8. The dryer of claim 7 wherein the web has at least two longitudinal protrusions and the rollers have at least two guiding grooves therein for cooperating with the protrusions.

9. The dryer of claim 7 further comprising a second conveyor adjacent the conveyor and cooperating therewith.

10. The dryer of claim 9 wherein each conveyor includes a plurality of rollers.

11. The dryer of claim 1 wherein the web supports discrete textiles.

12. The dryer of claim 1 further comprising a heating element selected from the group consisting of a gas heater, electric heater, and an infrared radiant heating element.

* * * * *